US007756439B2

(12) United States Patent
Kosuge et al.

(10) Patent No.: US 7,756,439 B2
(45) Date of Patent: Jul. 13, 2010

(54) IMAGE FORMING APPARATUS AND PROCESS CARTRIDGE USED THEREIN

(75) Inventors: Akio Kosuge, Yokohama (JP); Takaya Muraishi, Kawasaki (JP); Takeshi Shintani, Kawasaki (JP); Yasushi Akiba, Yokohama (JP); Satoshi Hatori, Yokohama (JP); Kaoru Yoshino, Tokyo (JP)

(73) Assignee: Ricoh Company Limited, Tokyo (JP)

( * ) Notice: Subject to any disclaimer, the term of this patent is extended or adjusted under 35 U.S.C. 154(b) by 125 days.

(21) Appl. No.: 12/201,396

(22) Filed: Aug. 29, 2008

(65) Prior Publication Data

US 2009/0060554 A1 Mar. 5, 2009

(30) Foreign Application Priority Data

Aug. 30, 2007 (JP) ..... 2007-223519

(51) Int. Cl.
*G03G 15/02* (2006.01)

(52) U.S. Cl. ..... 399/100

(58) Field of Classification Search ..... 399/44, 399/71, 100, 174, 175, 176
See application file for complete search history.

(56) References Cited

U.S. PATENT DOCUMENTS

| | | | | |
|---|---|---|---|---|
| 5,557,373 | A | 9/1996 | Miyashita et al. | |
| 5,697,020 | A | 12/1997 | Sato et al. | |
| 5,946,529 | A | 8/1999 | Sato et al. | |
| 7,127,190 | B2 * | 10/2006 | Gumbe | 399/100 |
| 7,139,504 | B2 | 11/2006 | Yanagida et al. | |
| 7,218,877 | B2 | 5/2007 | Yanagida et al. | |
| 7,266,324 | B2 | 9/2007 | Yanagida et al. | |
| 7,460,810 | B2 * | 12/2008 | Sampe et al. | 399/100 |
| 2002/0172525 | A1 | 11/2002 | Sugiura | |
| 2005/0191081 | A1 | 9/2005 | Muraishi et al. | |
| 2008/0124117 | A1 | 5/2008 | Muraishi et al. | |

FOREIGN PATENT DOCUMENTS

| | | |
|---|---|---|
| JP | 6-250504 | 9/1994 |
| JP | 7-128958 | 5/1995 |
| JP | 9-127767 | 5/1997 |
| JP | 10-232535 | 9/1998 |
| JP | 2001-42703 | 2/2001 |
| JP | 2007-225725 | 9/2007 |

* cited by examiner

*Primary Examiner*—Hoang Ngo
(74) *Attorney, Agent, or Firm*—Oblon, Spivak, McClelland, Maier & Neustadt, L.L.P.

(57) ABSTRACT

An image forming apparatus includes multiple imaging units and a controller. The multiple imaging units each include a photoconductor, a charging device, a developing device, a retractable cleaner, and a cleaner retraction mechanism. The charging device charges the photoconductor for forming an electrostatic latent image thereon. The developing device develops the electrostatic latent image. The retractable cleaner cleans the charging device when in contact with the charging device. The cleaner retraction mechanism is configured to bring the retractable cleaner into contact with the charging device. The charging device and the photoconductor are installed and replaced in conjunction with each other. The controller calculates a photoconductor usage of each of the multiple imaging units, and individually controls the cleaner retraction mechanism in each of the multiple imaging units according to the calculated photoconductor usage.

17 Claims, 6 Drawing Sheets

IMAGE FORMING APPARATUS AND PROCESS CARTRIDGE USED THEREIN

CROSS-REFERENCE TO RELATED APPLICATIONS

The present patent application claims priority pursuant to 35 U.S.C. §119 from Japanese Patent Application No. 2007-223519 filed on Aug. 30, 2007, the contents of which are hereby incorporated by reference herein in their entirety.

BACKGROUND OF THE INVENTION

1. Field of the Invention

The present invention relates to an image forming apparatus and a process cartridge used therein, and more particularly, to an image forming apparatus that uses a charging device to form electrophotographic images and a process cartridge implementing such image forming capabilities.

2. Discussion of the Background

Charging devices are used in electrophotographic imaging systems, such as photocopiers, facsimiles, printers, or the like, where an electrostatic charge is generated to form an electrostatic latent image on a photoconductive surface.

Typically, such electrophotographic charging devices are equipped with a cleaner that cleans the charging surface to ensure reliable charging performance for an extended period of time. There are several types of charging device cleaners, one common type of which includes a mechanical member that operates in contact with the charging device to remove contaminants by scrubbing or wiping.

It is known that holding the cleaning member continuously in contact with the charging device throughout the operation results in degraded and inefficient cleaning performance. This occurs when contaminants collected on the cleaning member transfer back to the charging device, or when the cleaning member is damaged due to the continuous operation.

To avoid such inefficiency, a conventional charging device cleaner is used with a retraction mechanism that retracts the cleaning member from the charging device so that cleaning is performed at set intervals regulated, for example, by the number of motor rotations or by the number of pages printed since a previous cleaning operation.

In addition, some control methods have been proposed to enhance efficiency in such retractable or intermittently operable cleaners. For example, one such method uses a sensor that detects contamination of a charging device in order to perform cleaning according to the actual level of contamination. Another control method involves determining the degree of contamination based on the imaging system's state of operation, such as consumption of developer material and ambient humidity detected, and performing cleaning according to the contamination degree thus determined.

Moreover, in recent years, high-speed color electrophotographic imaging apparatuses (referred to as "tandem printers") have come into common use. An electrophotographic color image is obtained by superimposing one atop another toner images of different primary colors. The tandem color printer includes multiple imaging units disposed in tandem with one another, one for black and others for non-black colors, each of which individually performs an electrophotographic process to obtain a toner image of a particular color.

Typically, such multiple imaging units in a tandem printer are subjected to different operating conditions. For example, the black imaging unit, involved in the formation of both black-and-white (monochrome) and full-color images, may be used more frequently than the non-black imaging units, which are not employed in the black-and-white image formation. Moreover, the tandem imaging units in the same printer are not necessarily replaced at a same time. Such difference in replacement timing results when the black imaging unit employed more frequently has a shorter service lifetime than the other imaging units, and when a breakdown occurs in only one imaging unit requiring replacement before the end of its intended service lifetime.

The different operating conditions in the tandem imaging units cause different degrees of contamination of the multiple charging devices included in the imaging process, making it difficult to properly clean each individual charging device. Naturally, a failure in proper cleaning leads to unsatisfactory performance of the charging device and corresponding degradation of imaging quality.

SUMMARY OF THE INVENTION

Exemplary aspects of the present invention are put forward in view of the above-described circumstances, and provide a novel image forming apparatus that uses a charging device to form electrophotographic images.

Other exemplary aspects of the present invention provide a novel process cartridge for use in an image forming apparatus that uses a charging device to form electrophotographic images.

In one exemplary embodiment, the novel image forming apparatus includes multiple imaging units and a controller. The multiple imaging units are configured to perform electrophotographic image formation and each includes a photoconductor, a charging device, a developing device, a retractable cleaner, and a cleaner retraction mechanism. The charging device is configured to charge the photoconductor for forming an electrostatic latent image thereon. The developing device is configured to develop the electrostatic latent image. The retractable cleaner is configured to clean the charging device when in contact with the charging device. The cleaner retraction mechanism is configured to bring the retractable cleaner into contact with the charging device. The charging device and the photoconductor are installed and replaced in conjunction with each other. The controller is configured to calculate a photoconductor usage of each of the multiple imaging units, and individually control the cleaner retraction mechanism in each of the multiple imaging units according to the calculated photoconductor usage.

In one exemplary embodiment, the process cartridge includes a photoconductor, a charging device, and a retractable cleaner. The charging device is configured to charge the photoconductor for forming an electrostatic latent image thereon. The retractable cleaner is configured to clean the charging device when in contact with the charging device. The charging device, the photoconductor, and the retractable cleaner are integrally mounted in the process cartridge. The process cartridge is detachably attached to an image forming apparatus. The image forming apparatus includes a developing device, a cleaner retraction mechanism, and a controller. The developing device is configured to develop the electrostatic latent image. The cleaner retraction mechanism is configured to bring the retractable cleaner into contact with the charging device. The controller is configured to calculate a photoconductor usage of the process cartridge, and individually control the cleaner retraction mechanism according to the calculated photoconductor usage.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
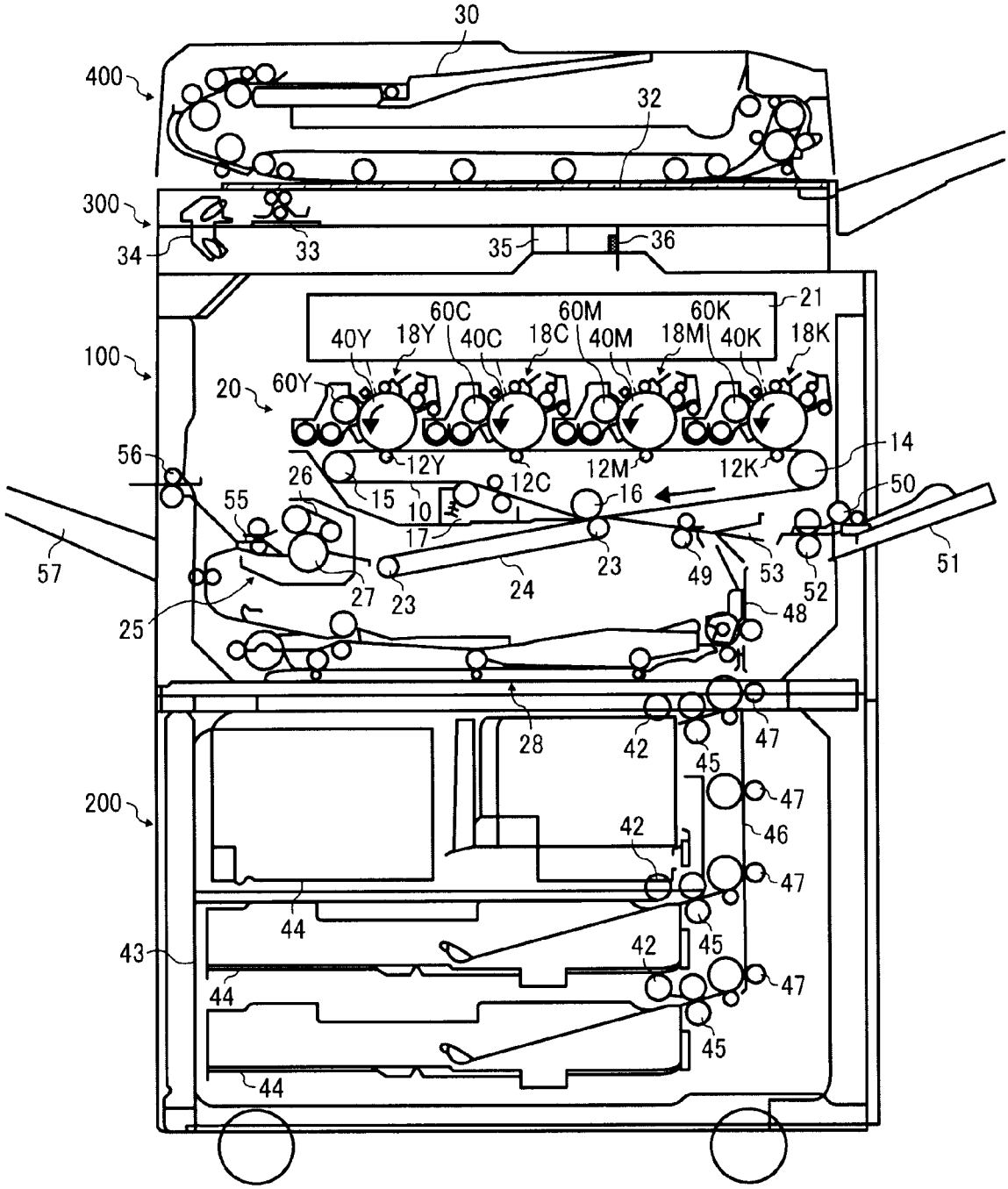
FIG. 1 is a schematic diagram illustrating a general arrangement of an image forming apparatus according to this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 is a schematic diagram illustrating a general arrangement of an image forming apparatus 100 according to this patent specification.

As shown in FIG. 1, the image forming apparatus 100 is configured as a color laser printer with a sheet feeder 200, a scanner 300, and an automatic document feeder (ADF) 400, stacked in a tiered arrangement.

The image forming apparatus 100 incorporates a tandem imaging system 20 in which four electrophotographic imaging units 18Y, 18C, 18M, and 18K are disposed side by side. The imaging units 18Y, 18C, 18M, and 18K each includes a drum-shaped photoconductor 40Y, 40C, 40M, and 40K, respectively, and a developing device 60Y, 60C, 60M, and 60K, respectively, as well as other imaging elements omitted in the drawing for simplicity.

The imaging units 18Y, 18C, 18M, and 18K are substantially identical in basic configuration and operation, except for the color of toner and the image signals provided for imaging processes. In this patent specification, the suffix letters assigned to reference numerals each refers to components associated with a particular toner color used in the image forming apparatus 100, where "Y" denotes yellow, "C" for cyan, "M" for magenta, and "K" for black. Thus, components marked with the same suffix will be regarded as elements associated with each other, while components marked with the same numeric character will be regarded as equivalent and/or corresponding elements. These suffixes will be omitted for ease of illustration and explanation where the statements presented are equally applicable to all the components designated by the same reference number.

Above the imaging system 20 is located an exposure device 21, which includes four diode laser sources for the multiple imaging units 18 and a motor-driven polygon scanner formed of a six-faceted mirror, not shown in the drawing. Other optical elements, such as an f-theta lens, a wide toroidal lens, reflecting mirrors, etc., are also provided to define a light path through which a laser beam modulated according to image data and emitted from each laser source is deflected by the polygon scanner and directed to scan the photoconductor 40.

Below the imaging system 20, an endless belt 10 is trained around a drive roller 14 and support rollers 15 and 16 to form an intermediate transfer system, where four transfer rollers 12Y, 12C, 12M, and 12K each forms a primary transfer nip with a corresponding one of the photoconductors 40Y, 40C, 40M, and 40K. When the drive roller 14 rotates, the primary transfer belt 10 travels clockwise in the drawing to pass through the four transfer nips one after another, with an outer surface cleaned by a belt cleaning device 17 disposed downstream of the support roller 16.

The primary transfer belt 10 may be a seamless belt formed of a resin material, such as polyvinyl fluoride, polyimide, polycarbonate, or polyethylene terephthalate, with or without a conductive material added, such as carbon black or the like, to control electrical resistivity of the resin belt. It is also contemplated to form the belt 10 in a multi-layered or laminated structure using a resin base spray-coated or dip-coated with an appropriate material.

Downstream of the primary transfer system, a secondary transfer system 24 and a fixing device 25 are located adjacent to each other.

The secondary transfer system 24 is configured as an endless belt trained around a pair of rollers 23, one of which is held against the support roller 16 to form a secondary transfer nip where the outer surfaces of the primary and secondary transfer belts 10 and 24 come into contact with each other. The secondary transfer belt 24 serves to convey a sheet on an outer surface thereof, and may be formed of a material similar to that of the primary transfer belt 10. Forming the secondary transfer system with a roller or a charger instead of a belt is also possible, in which case an appropriate mechanism is required to provide the sheet conveying capability.

The fixing device 25 is configured as a pressure roller 27 with an outer surface pressed against an endless belt 26.

Additionally, a sheet reversing device 28 lies below the transfer system 24 and the fixing device 25 parallel to the length of the tandem imaging system 20. The sheet reversing device 28 is used to reverse a recording sheet for reverse output or for printing in duplex mode.

To perform printing in the image forming apparatus 100, image data is captured from an original document using the ADF 400 and the scanner 300.

First, an original document is placed face down on a transparent platen glass 32 of the ADF 400 and a start button of a control panel, not shown, is pressed to initiate a scanning process. This may be done automatically, where a user places the original on a document tray 30 and presses the start button to activate an automatic transport function, or manually, where a user lifts up a cover of the ADF 400, places the original on the platen glass 32, closes the cover over it, and presses the start button.

Upon activation, the scanner 300 directs a first optical element 33 emitting light from a light source and a second optical element 34 reflecting light with a mirror to traverse the face of the original document. Light emitted from the first optical element 33 is reflected off the document face, reaching the second element 34, and further directed toward an imaging lens 35, which causes reflected light rays to enter a read sensor 36. The read sensor 36 then analyzes the incoming light to derive the original image information (data).

After the image data is thus obtained, the image forming apparatus 100 performs printing in either a full-color mode or a black-and-white (monochrome) mode. The printing mode may be selected manually by a user through the control panel, or automatically by computing based on the captured image data.

When the full-color mode is selected, the imaging system 20 activates the four imaging units 18Y, 18C, 18M, and 18K to perform a color electrophotographic imaging process using the four photoconductors 40Y, 40C, 40M, and 40K.

In each imaging unit 18, the photoconductor 40 rotates counterclockwise in the drawing so as to forward a photoconductive surface to various imaging processes. First, the photoconductive surface is uniformly charged by the charging device and selectively exposed to a modulated laser beam emitted from the exposure device 21, so as to obtain an electrophotographic latent image on the photoconductive surface according to image data for each corresponding color. The obtained latent image is developed by the developing device 60 using toner, and transferred onto the primary transfer belt 10 at the primary transfer nip. Thereafter, the photoconductor 40 is discharged to remove any remaining charge by a discharger lamp, not shown, followed by a cleaning process that removes residual toner or other materials from the photoconductive surface.

Toner images transferred from the four photoconductors 40Y, 40C, 40M, and 40K are superimposed one atop another to form a full-color image on the primary transfer belt 10. The primary transfer belt 10 rotates to advance the formed image toward the secondary transfer nip.

When the black-and-white mode is selected, the imaging system 20 activates the black imaging unit 18K to perform an electrophotographic imaging process using the photoconductor 40K, and the support roller 15 moves away from the imaging system 20 so as to separate the primary transfer belt 10 from the photoconductors 40Y, 40C, and 40M while maintaining the photoconductor 40K in contact with the belt surface.

In the imaging unit 18K, the photoconductor 40K rotates counterclockwise in the drawing so as to forward a photoconductive surface to the charging, exposure, developing, and other necessary processes described above, where an electrostatic latent image is created with a laser beam modulated according to image data for the color black and developed into visible form using black toner. Throughout the black toner image formation, the photoconductors 40Y, 40C, and 40M, and the developing devices 60Y, 60M, and 60K, responsible for the formation of non-black toner images remain idle to prevent photoconductor degradation and loss of developer material.

The black toner image thus obtained is transferred onto the primary transfer belt 10 at the primary transfer nip, and advanced toward the secondary transfer nip as the primary transfer belt 10 rotates.

In the sheet feeder 200, one of feed rollers 42 is selected to feed recording sheets from a corresponding one of sheet cassettes 44, which recording sheets are separated and forwarded individually into a feed path 46 by a separator roller 45. Each fed sheet is conveyed and introduced into a feed path 48 of the image forming apparatus 100 by rotating transport rollers 47.

Such sheet feed may also be performed manually using a manual feed tray 51. In such cases, recording sheets are loaded onto the feed tray 51 to be introduced into the image forming apparatus 100 by rotation of a feed roller 50. The fed sheets are forwarded individually by a separator roller 52 into a manual feed path 53.

The recording sheet entering the feed path 48 or the manual feed path 53 stops with its leading edge held between a pair of registration rollers 49. The registration rollers 49 start rotation to advance the recording sheet in synch with the movement of the primary transfer belt 10, so that the toner image is transferred from the belt surface onto the recording sheet at the secondary transfer nip.

Thereafter, the secondary transfer belt 24 transports the recording sheet to the fixing unit 25, which fixes the powder toner image onto the recording sheet with a combination of heat and pressure.

The recording sheet thus bearing a finished image thereon is forwarded to an output tray 57 or to the sheet reversing unit 28. When duplex printing is intended, a diverter 55 directs the recording sheet to the sheet reversing unit 28, which re-feeds the incoming sheet upside down into the sheet path, so that printing is performed on both sides of the recording sheet. After printing, the diverter 55 directs the recording sheet toward an output roller 56, which rotates to eject the sheet onto the output tray 57.

The above printing process is repeated until a specified number of print jobs are completed. Upon print job completion, the imaging system 20 performs a given routine to condition the photoconductor 40 employed in printing, wherein the discharging device discharges the photoconductive surface as the photoconductor 40 makes several turns without charge bias or transfer bias applied thereto. Such treatment prevents degradation of the photoconductor 40 while the imaging unit 20 is left idle with charges remaining on the photoconductive surface.

Figure 2:
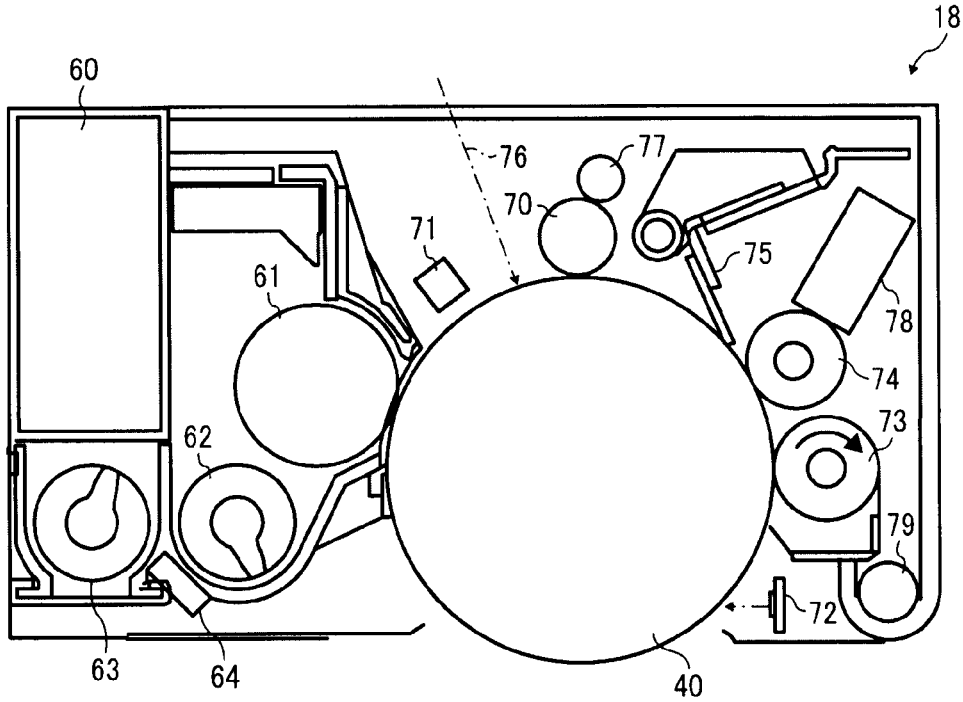
FIG. 2 is a schematic diagram illustrating an exemplary configuration of an imaging unit used in the image forming apparatus of FIG. 1.

Referring to FIG. 2, a schematic diagram illustrating an exemplary configuration of the photoconductor 40, the developing device 60, and other imaging elements, a description is given that is equally applicable to each of the four imaging units 18Y, 18C, 18M, and 18K of the image forming apparatus 100.

As shown in FIG. 2, the photoconductor 40 has a photosensitive surface surrounded counterclockwise in the drawing by a charge roller 70, a potential sensor 71, the developing device 60, a discharger lamp 72, and a photoconductor cleaner formed of brush rollers 73 and 74 and a polyurethane blade 75. These imaging elements are enclosed in a housing with an aperture, not shown, through which a laser beam 76 emitted from the exposure device 21 reaches the photosensitive surface downstream of the charge roller 70.

In the imaging unit 18, the charge roller 70 serves to uniformly charge the photoconductor 40. As will be described later in more detail, the charge roller 70 is designed to function in close proximity to the photoconductive surface and is equipped with a charge roller cleaner 77 for removing contaminants from the charge roller surface.

The laser beam 76 forms an electrostatic latent image by selectively removing charges on the photoconductive surface according to image data for the corresponding primary color. The potential sensor 71 serves to measure an electrical potential on the charged photoconductive surface.

The developing device 60 serves to develop the electrostatic latent image into a toner image with a development roller 61, screw conveyors 62 and 63, and a toner concentration sensor 64, enclosed in a housing containing a two-component developer formed of toner and carrier particles.

In the developing device 60, the screw conveyors 62 and 63 rotate to convey and agitate contents of the housing so as to impart triboelectric charges to the developer particles. The development roller 61, formed of a rotatable sleeve with a magnet held stationary inside, magnetically attracts the developer and brings the attracted particles into close proximity to the photoconductor 40. Toner particles on the development roller 61 are then attracted to the charged areas of the photoconductive surface to develop the electrostatic latent image into visible form.

While not shown in the drawing, the developing device 60 is provided with a toner supply located above the housing, which derives fresh toner from an external toner reservoir and supplies a required amount of toner with a rotatable screw conveyor to impel the particles to an outlet port leading to the developing device 60. The concentration sensor 64 serves to detect a concentration of toner in the developer after development and signals the toner supply to dispense a supply of toner as required. Upon receiving the sensor output, the toner supply engages a clutch to rotate the screw conveyor, and supplies an amount of toner corresponding to the duration of screw rotation downward to the developing device 60 via the outlet port.

Downstream from the developing device 60, the discharger lamp 72 serves to remove charges remaining on the photoconductor 40 after transfer of the toner image, followed by the photoconductor cleaner cleaning and preparing the photoconductor 40 for a subsequent imaging cycle.

In the photoconductor cleaner, the brush rollers 73 and 74 and the cleaning blade 75 scrub and remove residual toner away from the photoconductive surface, after which the removed particles are collected by a coil 79 to be transported to a toner waste bin, not shown.

In addition, the brush roller 74 is held in contact with a solid lubricant 78 and serves to apply lubricant to the photoconductive surface. Specific examples of the solid lubricant 78 include metal salts of aliphatic acid such as zinc stearate, barium stearate, iron stearate, nickel stearate, cobalt stearate, copper stearate, strontium stearate, calcium stearate, magnesium stearate, zinc oleate, cobalt oleate, magnesium oleate and zinc paltimate, natural wax such as carnauba wax, fluorine based resins such as polytetrafluoroethylene.

While the photoconductor cleaner is located downstream of the discharger lamp 72 in the illustrated embodiment, it is also possible for the photoconductor cleaning to be followed by the discharging process.

Figure 3:
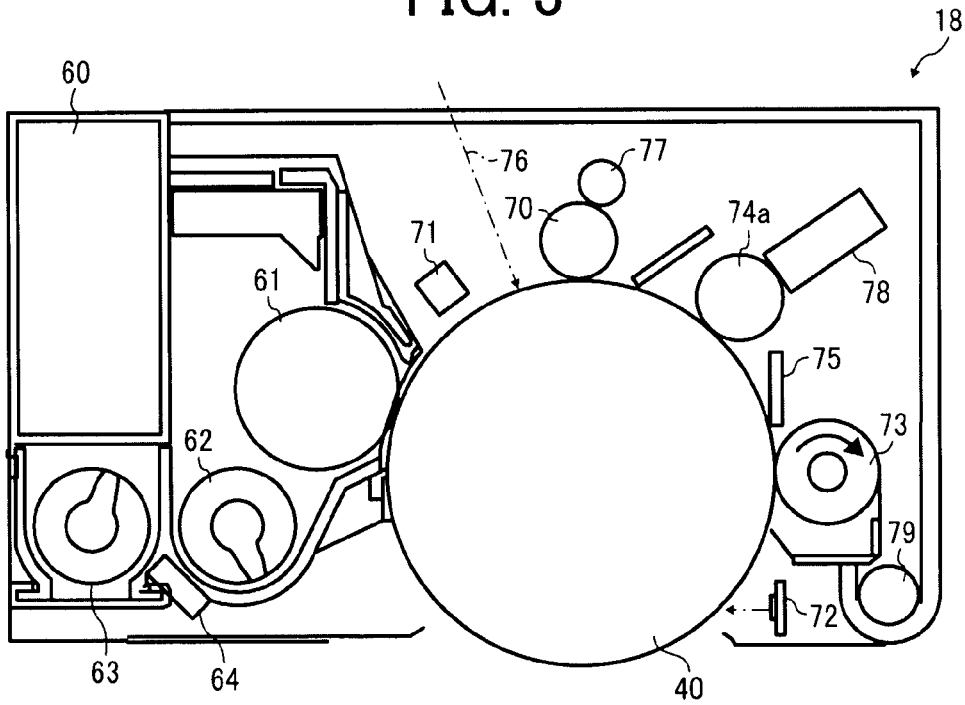
FIG. 3 is a schematic diagram illustrating another exemplary configuration of an imaging unit used in the image forming apparatus of FIG. 1.

Alternatively, the imaging unit 18 may be configured to have a lubricant applicator 74*a* and the lubricant 78 downstream of a photoconductor cleaner formed of the brush roller 73 and the cleaning blade 75 as shown in FIG. 3. Separating the lubrication process from the cleaning process enables stable lubrication of the photoconductor 40, which would be difficult in the configuration of FIG. 2 where the amount of lubricant applied to the photoconductive surface is varied with the amount of toner untransferred or transferred back to enter the photoconductor cleaner, which depends on areas of images printed.

Figure 4:
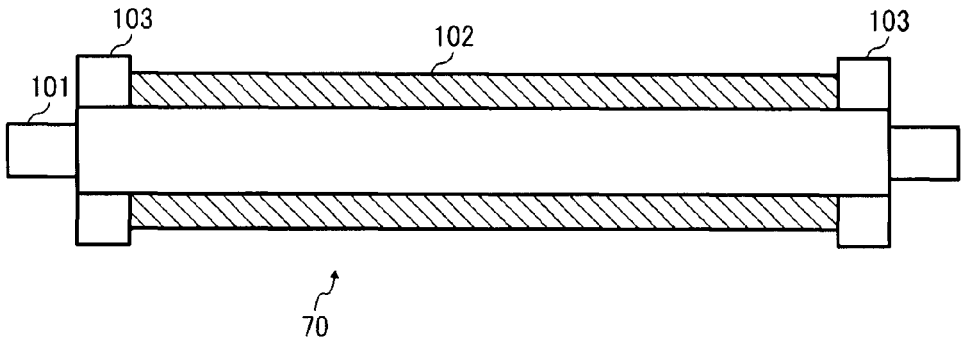
FIG. 4 shows an example of a charge roller used in the imaging unit according to this patent specification.

Referring to FIG. 4, an example of the charge roller 70 used in the imaging unit 18 is described.

As shown in FIG. 4, the charge roller 70 is formed of a metal core 101 coated with a resin layer 102 and a pair of spacer wheels 103 at opposite ends of the resin coating.

In use, the charge roller 70 is mounted in close proximity to the photoconductor 40, with the spacer wheels 103 held in contact with a non-imaging region of the photoconductive surface so as to form a gap or spacing between the resin layer 102 and the photoconductive surface. Although not depicted in the drawing, the charge roller 70 has a gear that engages a gear on a flange of the photoconductor 40, so that the charge roller rotates with the photoconductor 40 in a common direction at a substantially identical linear speed upon activation of a photoconductor drive motor, not shown.

The gap between the resin layer 102 and the photoconductive surface may be approximately 100 μm at maximum, since an excessively large gap causes abnormal discharge and/or non-uniform charge distribution on the photoconductive surface. Preferably, the charge roller 70 in such non-contact design is used with a bias voltage obtained by superimposing an alternating current (AC) voltage on a direct current (DC) voltage.

In fabricating the charge roller 70, the resin layer 102 is formed on the metal core 101, and the spacer wheels 103, pre-molded, are secured on the metal core 101 at opposite ends of the resin layer 102 through press-fit and/or bonding. After the resin layer 102 and the spacer wheels 103 are thus joined together on the metal core 101, further processing, such as cutting or grinding, is performed on the outer surface of the charge roller 70 so as to properly align the resin layer 102 and the spacer wheels 103, thereby forming a consistent gap between the charge roller 70 and the photoconductor 40.

The metal core 101 is made of appropriate conductive material such as stainless steel. Preferably, the diameter of the metal core 101 is in the range of approximately 6 to approximately 10 millimeters, since a metal core thicker than such range increases the overall size and weight of the charge roller 70 whereas a thinner metal core can be deformed by processing or cutting of the resin layer during fabrication or by pressing the roller against the photoconductor through use, leading to improper alignment or spacing with the photoconductor 40.

The resin layer 102 is formed of appropriate material with a volume resistivity ranging from approximately $10^4$ to approximately $10^9$ Ω*cm. An excessively low resistivity of the conductive layer 102 would cause a leakage of bias current when the photoconductive surface suffers defects such as pinholing. An excessively high resistivity would result in insufficient discharging, causing non-uniform charge distribution on the photoconductive surface. The resistivity of resin material may be adjusted by adding appropriate conductive material.

Specific examples of resin base include polyethylene, polypropylene, methyl polymethacrylate, polystyrene, copolymers of acrylonitrile-butadiene-styrene and polycarbonate. These plastic resins are readily molded into a desired shape.

Specific examples of conductive material include ion conductive materials such as polymers or polyolefins having a quaternary ammonium base. Such polyolefins include polyethylene, polypropylene, polybutane, polyisoplene, copolymers of ethylene, ethylacrylate, copolymers of ethylene and methylacrylate, copolymers of ethylene and vinyl acetate, copolymers of ethylene and propylene, and copolymers of ethylene and hexane. It should be appreciated that the conductive material may be any suitable polymer with a quaternary ammonium base other than the polyolefins recited above.

The ion conductive material is uniformly mixed with the resin base using appropriate equipment, such as a two-roll mill, a kneader, and the like. The mixed material is easily formed into a layer on the metal core 101 by injection-molding or extraction-molding. The mixing ratio of the ion conductive material in the resin may be approximately from 30 to 80 parts by weight of conductive material with 100 parts by weight of resin base.

The thickness of the resin layer 102 may be in the range of approximately 0.5 to approximately 3 millimeters. A resin layer thinner than such range would be difficult to mold and susceptible to degradation under stress, whereas too thick a resin layer would increase overall size of the discharge roller 70 and decrease charging efficiency due to increased actual resistance of the layer.

The spacer wheels 103 may be formed using resin similar to that used in forming the conductive layer, such as polyethylene, polypropylene, methyl polymethacryalte, polystyrene, copolymers of acrylonitrile-butadiene-styrene, and polycarbonate. Preferably, the resin material used for the spacer wheels 103 is relatively soft, so as not to damage the photoconductive surface when brought in contact with the photoconductor 40.

To obtain good sliding and softness of the spacer wheels 103, resins other than those recited above may also be used, such as polyacetal, copolymers of ethylene and ethyl acrylate, polyvinylidene fluoride, copolymers of tetrafluoroethylene and perfluoroalkyl vinyl ether, and copolymers of tetrafluoroethylene and hexafluoropropylene. In addition, the resin layer 102 and the spacer wheels 103 each may be coated with a layer of several tens of millimeters so as to avoid contamination from toner or other materials.

Although the non-contact charge roller 70 is described above, the imaging unit 18 may instead use a contact charging device, such as a roller or a brush, which functions in direct contact with the photoconductive surface. Nevertheless, a contact charge roller tends to accumulate materials rubbed off from the photoconductive surface during rotation with the photoconductor, which in most cases build up into sticky deposits. By contrast, the non-contact design prevents toner or other materials from transferring from the photoconductor 40 to the charge roller 70 during the charging process, effectively reducing contamination of the charge roller surface. Further, the non-contact charge roller 70 prevents wear on the photoconductive surface even when the charge roller 70 includes a hard resin material and/or the photoconductor 40 is of an organic material.

As mentioned, the charge roller 70 according to this patent specification is provided with the charge roller cleaner 77 to remove contaminants from the charge roller surface. Such a cleaning mechanism is required regardless of whether the charging device is of a contact design or of a non-contact design, because even a non-contact charging device can be contaminated with a certain amount of toner or toner additives attracted by the DC bias on which an AC voltage is superimposed to obtain uniform charge on the photoconductor.

Figure 5:
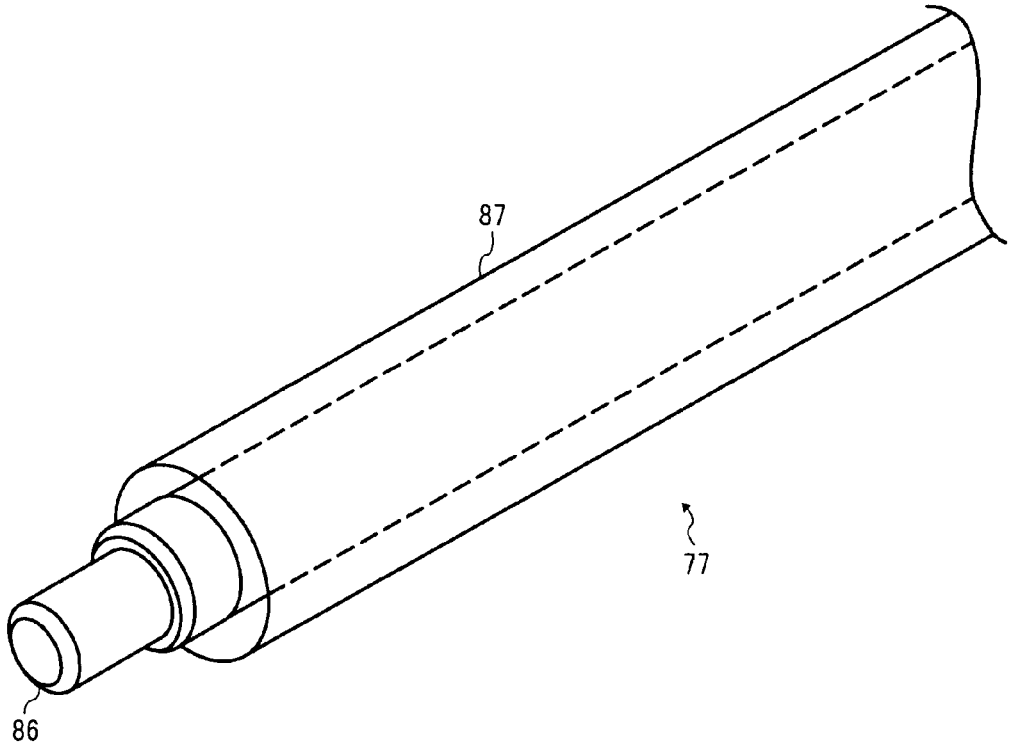
FIG. 5 shows an example of a charge roller cleaner used in the imaging unit according to this patent specification.

FIG. 5 shows an example of the charge roller cleaner 77 used in the imaging unit 18 according to this patent specification.

As shown in FIG. 5, the charge roller cleaner 77 is a rotatable roller formed of a metal core 86 coated with a layer 87 of porous material. In use, the charge roller cleaner 77 is held in rolling contact with the charge roller 70 so that the porous layer 87 removes contaminants from the surface of the charge roller 70 as the charge roller cleaner 77 rotates with the charge roller 70.

The porous layer 87 is preferably formed of a melamine foam. Melamine foam is superior to other sponge-like material due to its durability and long-term performance with a large number of micro-pores accommodating contaminants collected over a long period of use.

Although the charge roller cleaner 77 described above is a rotatable roller that operates in rolling contact with the charge roller 70, any suitable configuration, such as sponge or brush, may also be used to clean the charge roller surface. Nevertheless, the cleaning roller in rolling contact with the charge roller is superior to a configuration where a cleaner and a charging device are disposed in sliding frictional contact to cause contaminants accumulated on the cleaning surface to transfer back to the charging device.

In addition, the charge roller cleaner 77 according to this patent specification is equipped with a cleaner retraction mechanism that enables the charge roller cleaner 77 to move into and out of contact with the charge roller 70. Experience indicates that holding the roller cleaner continuously in contact with the charge roller results in reduced cleaning efficiency, because contaminants collected by the roller cleaner build up on the cleaning surface over time and eventually rub off and transfer to the surface of the charge roller. Moreover, such continuous contact is not necessary or appropriate when the charge roller is used with the DC bias with an AC voltage superimposed thereon, which alternately attracts and repels particles present on the photoconductive surface.

Figure 6:
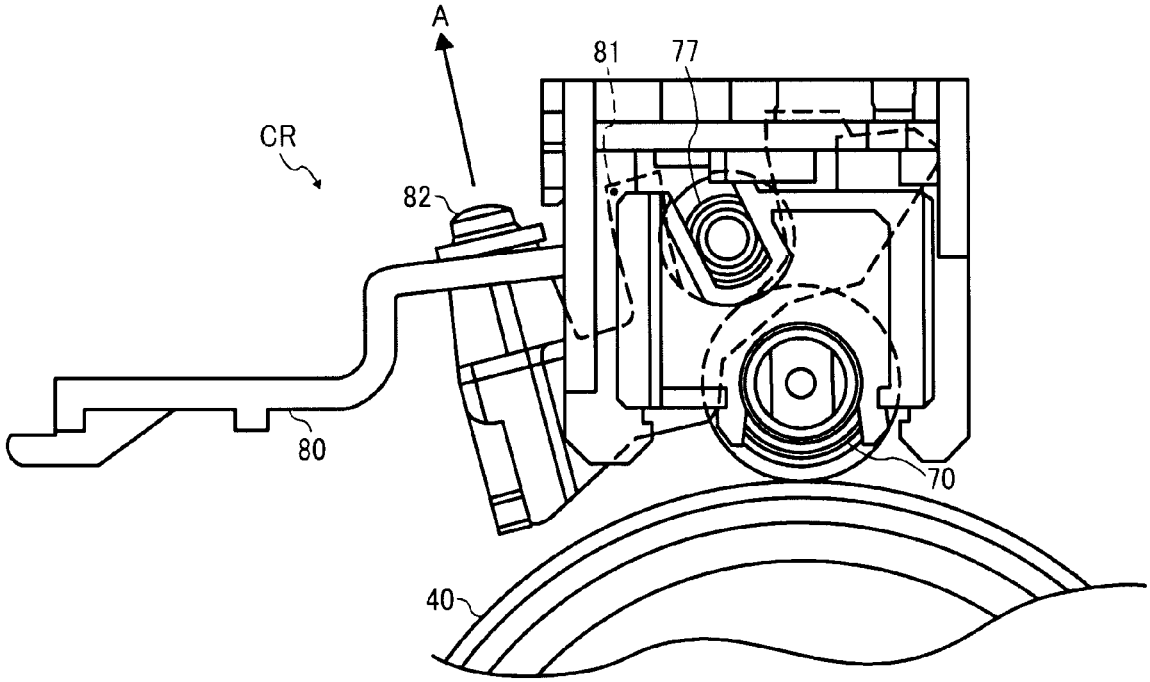
FIG. 6 schematically illustrates an example of the cleaner retraction mechanism in use in conjunction with the charge roller cleaner of FIG. 5.

FIG. 6 schematically illustrates an example of the cleaner retraction mechanism CR in use in conjunction with the charge roller cleaner 77.

As shown in FIG. 6, the cleaner retraction mechanism CR is mounted in a frame 80, where the charge roller cleaner 77 of the roller type has opposite ends supported by an arm 81 with a protrusion 82 located in contact with a solenoid, not shown, provided within the imaging unit 18.

In the drawing, the charge roller cleaner 77 is engaged in rolling contact with the charge roller 70 with the protrusion 82 urged downward by the solenoid, so that the charge roller cleaner 77 cleans the charge roller surface while rotating with the charge roller 70 as the photoconductor 40 rotates.

When charge roller cleaning is complete, the solenoid is actuated to release the protrusion 82 in the direction of arrow A, so that the charge roller cleaner 77 is retracted from the charge roller 70. Thus, the charge roller cleaner 77 remains out of contact with the charge roller 70 until a subsequent cleaning operation is triggered.

The engaging/retracting action of the solenoid illustrated above transmits vibrations to neighboring components such as the exposure device, which may adversely affect imaging quality when occurring during image formation. To avoid such adverse effect of the solenoid movement, the solenoid-triggered cleaner retraction mechanism CR according to this patent specification is designed to function while the imaging unit 18 is not in service, so that charge roller cleaning takes place during intervals between print jobs. In addition, it is desirable to set cleaning frequency as low as possible so as not to increase user waiting time.

Experiments, described below, were performed to evaluate effectiveness and performance of the charge roller cleaning with the retraction mechanism CR according to this patent specification.

In all the experiments conducted, an image forming apparatus, Imagio Neo C600 manufactured by Ricoh Company, Ltd., was used to print test patterns in which each primary color constituted 5% of the image area. Each test pattern was printed successively on 5 sheets of A4 copy paper, producing a total of 150,000 prints corresponding to an ordinary service lifetime of imaging units used in the image forming apparatus. After printing, obtained images were inspected at a low temperature of 10° C. and a low humidity of 15% to determine the presence of print defects resulting from charge roller contamination.

EXPERIMENT 1

Printing was performed at room temperature and humidity using an imaging unit adapted to have the cleaner retraction mechanism as shown in FIG. 6, the charge roller cleaner formed of melamine foam as shown in FIG. 5, and the non-contact charge roller formed of resin and rotatable with the photoconductor as shown in FIG. 4.

The charge roller cleaner was held away from the roller surface during printing, and the cleaner retraction mechanism was triggered after every 2,500 printing cycles to urge the charge roller cleaner into rolling contact with the charge roller, and to retract the charge roller cleaner after 10 seconds of cleaning.

In Experiment 1, no image defect resulting from charge roller contamination was observed.

EXPERIMENT 2

The experiment was conducted under conditions similar to those used in Experiment 1, except that charge roller cleaning was performed after every 5,000 printing cycles.

In Experiment 2, no image defect resulting from charge roller contamination was observed.

EXPERIMENT 3

The experiment was conducted under conditions similar to those used in Experiment 1, except that a contact charging device formed of a rubber roller was used, which functions in rolling contact with the photoconductive surface.

In Experiment 2, unwanted vertical lines or streaks were present in low-density areas of printed pages after roughly 100,000 printing cycles, and also in background areas after roughly 150,000 printing cycles. Contaminants consisting of toner or other materials were observed on the surface of the contact charge roller in locations corresponding to the vertical streaks on the printed pages.

EXPERIMENT 4

The experiment was conducted under conditions similar to those used in Experiment 3, except that the cleaner retraction mechanism was not provided and the charge roller cleaner was held continuously in contact with the charge roller throughout the printing process.

In Experiment 4, unwanted vertical lines or streaks were present in low-density areas of printed pages after roughly 50,000 printing cycles, and also in background areas after roughly 100,000 printing cycles. Contaminants of toner or other materials were observed on the surface of the contact charge roller in locations corresponding to the vertical streaks on the printed pages.

EXPERIMENT 5

The experiment was conducted under conditions similar to those used in Experiment 3, except that the charge roller cleaner was not provided.

In Experiment 5, unwanted periodic patterns of dots were present in low-density areas of printed pages after roughly 50,000 printing cycles. Contaminants consisting of toner or other materials were observed on the surface of the contact charge roller in locations corresponding to the dot patterns on the printed pages.

EXPERIMENT 6

The experiment was conducted under conditions similar to those used in Experiment 1, except that the cleaner retraction mechanism was not provided and the charge roller cleaner was held continuously in contact with the charge roller throughout the printing process. In addition, printing was carried out using different atmospheric conditions, one at normal temperature and normal humidity and the other at low temperature and low humidity.

In Experiment 6, pages printed under the low temperature and low humidity condition had unwanted vertical lines or streaks in low-density areas and contaminants of toner or other materials were observed on the surface of the charge roller in locations corresponding to the vertical streaks, while such defects were not observed in pages printed under the normal temperature and normal humidity condition.

EXPERIMENT 7

The experiment was conducted under conditions similar to those used in Experiment 1, except that the charge roller cleaner was not provided. In addition, printing was carried out using different atmospheric conditions, one with normal temperature and normal humidity and the other with low temperature and low humidity.

In Experiment 7, pages printed under low-temperature and low-humidity conditions had unwanted periodic patterns of dots in low-density areas and contaminants of toner or other materials were observed on the surface of the charge roller in locations corresponding to the dot patterns, while such defects were not observed in pages printed under the normal temperature and normal humidity condition.

Results of the above experiments demonstrate that the charge roller cleaning with the cleaner retraction mechanism according to this patent specification provides efficient and reliable cleaning performance when used with the non-contact charge roller under appropriate operating conditions.

Namely, it is shown that the non-contact charge roller can be maintained sufficiently clean by performing charge roller cleaning at certain intervals, e.g., after printing on 5,000 sheets of A4 copy paper, and that a higher level of cleaning is required when the imaging unit is operated under low-temperature and low-humidity conditions.

The charge roller cleaning with the retractable cleaner described above is applied to the four imaging units 18Y, 18C, 18M, and 18K of the image forming apparatus 100.

As noted previously, the multiple imaging units 18Y, 18C, 18M, and 18K in the tandem printer 100 are subjected to different operating conditions. For example, the black imaging unit 18K, involved in the formation of both black-and-white (monochrome) and full-color images, may be used more frequently than the non-black imaging units 18Y, 18C, and 18M, which are not employed in the black-and-white image formation. Moreover, the imaging units 18Y, 18C, 18M, and 18K are not necessarily replaced at the same time. Such difference in replacement timing results when the black imaging unit 18K employed more frequently has a shorter service lifetime than the other imaging units 18Y, 18C, and 18M, and when a breakdown occurs in only one imaging unit to require replacement before the end of intended service lifetime. The different operating conditions in the tandem imaging units 18Y, 18C, 18M, and 18K cause different degrees of contamination of the multiple charging devices included in the image forming apparatus 100.

Taking into account these facts, the image forming apparatus 100 according to this patent specification individually controls charge roller cleaning of each imaging unit 18 according to the degree of contamination of the charge roller 40. The contamination degree is calculated from a usage of the photoconductor 40, i.e., a cumulative distance traveled by the photoconductive surface during image formation, working and replaceable in conjunction with the charge roller 70.

Specifically, the charge roller cleaning in each imaging unit 18 is individually controlled by regulating an interval between cleaning operations based on the photoconductor usage, where the cleaner retraction mechanism CR is triggered by the solenoid to perform cleaning when the photoconductor usage reaches a given reference level in each imaging unit 18.

Further, such individual control of the charge roller cleaning is made to be variable based on such operating factors as environmental conditions, amount of toner consumed, and the age of the imaging unit, all of which are relevant to the level of contamination and/or charging performance of the charge roller 70.

More specifically, environmental conditions such as temperature and humidity influence electrical properties of the charge roller and contaminant materials deposited on the roller surface. Namely, these materials exhibit increased resistivities at lower temperatures and lower humidities, resulting in insufficient or improper charging of the photoconductive surface.

According to this patent specification, the charge roller cleaning interval is adjusted according to the temperature and humidity under which the image forming apparatus and/or each imaging unit is operated so that cleaning takes place more frequently under cooler and drier conditions. Adjusting cleaning intervals according to the environmental conditions enables the charge roller cleaning to be performed properly and effectively so as to ensure a stable charging performance under varying environmental condition.

Similarly, the amount of toner consumed in the imaging unit is relevant to the degree of charge roller contamination. In general, the toner consumption is proportional to the amount of toner and toner additives remaining on the photoconductive surface after printing, failing to be removed due to the limited capacity of the photoconductor cleaning process. Thus, printing a good number of images containing large image areas increases the amount of residual toner on the photoconductive surface, which translates into an increased amount of contaminants transferring to the charge roller surface.

According to this patent specification, the charge roller cleaning interval is adjusted according to the amount of toner consumed in each individual imaging unit, so that cleaning takes place more frequently when there is an increased risk of contaminating the roller surface.

In such a configuration, the toner consumption is determined based on a ratio of image areas or number of pixels contained in a printed image to the entire printed image, indicating the amount of toner used in the imaging process. Alternatively, the toner consumption may be derived from the amount of toner supplied to the developing device, which may be suitable for a configuration in which the imaging unit uses a certain amount of toner besides image forming processes.

Adjusting cleaning intervals according to the toner consumption enables the charge roller cleaning to be properly performed as required by the level of contamination suffered by each individual charge roller.

Aging of the imaging unit also contributes to charge roller contamination. Namely, the photoconductor cleaner or the cleaning blade held in contact with the photoconductive surface deteriorates with use and aging of the imaging unit to cause an increased amount of residual toner to bypass the cleaning process, resulting in an increased amount of contaminants transferring to the charge roller surface.

According to this patent specification, the charge roller cleaning interval is adjusted according to the age of each individual photoconductor cleaner or the age of each individual imaging unit incorporating the photoconductor cleaning mechanism, so that cleaning takes place more frequently when there is an increased risk of contaminating the roller surface.

In such a configuration, each imaging unit is preferably configured as a process cartridge detachably attached to the image forming apparatus 100, in which a photoconductor, a photoconductor cleaner, and a charge roller are integrally mounted and replaceable at the same time as the imaging components age. Such a configuration enables precise determination of the age of the photoconductor cleaner, which would be difficult in a case in which the imaging components are replaced separately at different unidentifiable intervals.

Adjusting cleaning intervals according to the aging of the imaging unit or the process cartridge enables the charge roller cleaning to be properly performed as required by the level of contamination suffered by each individual charge roller.

Figure 7:
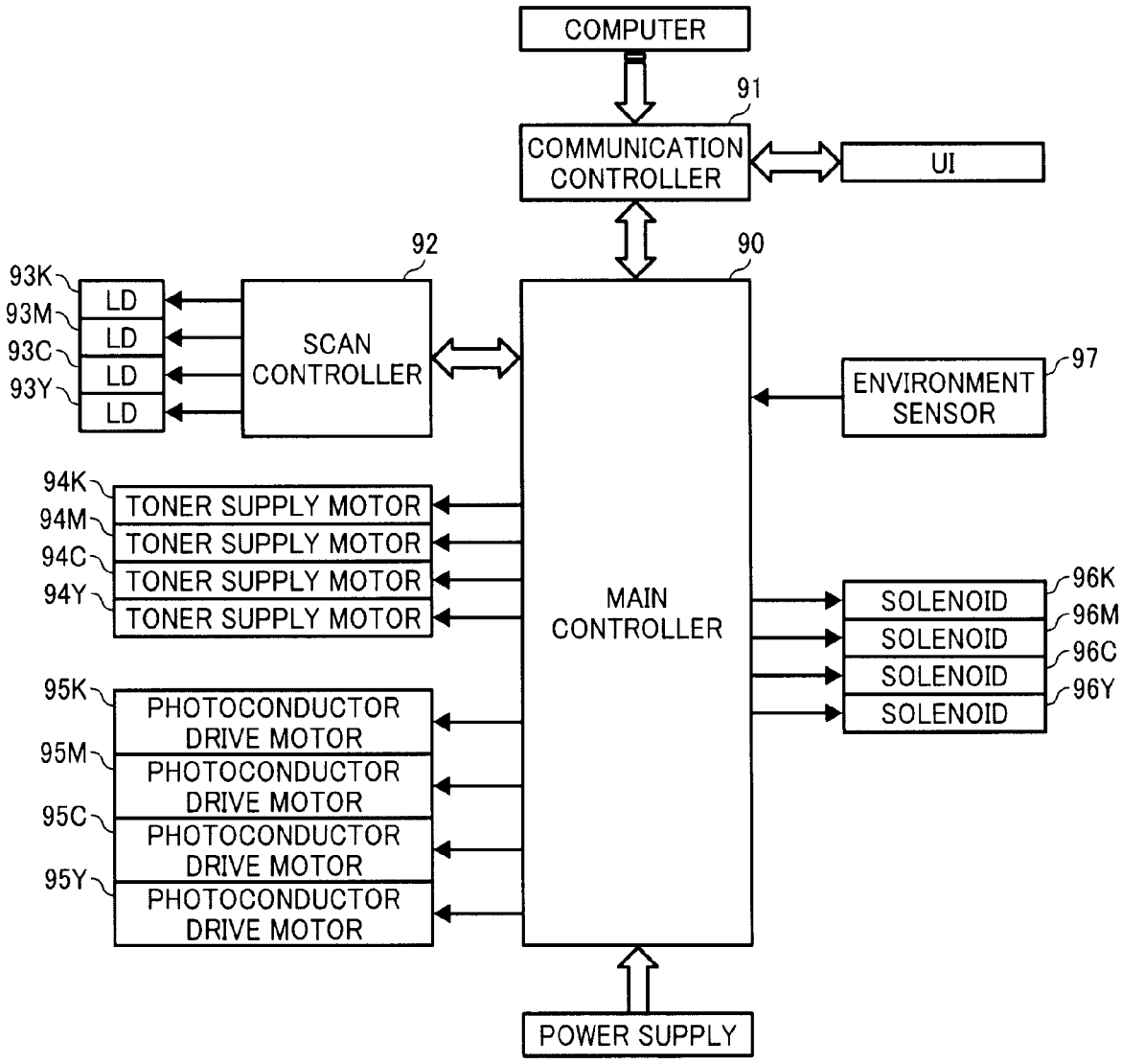
FIG. 7 is a block diagram illustrating control circuitry for individual control of charge roller cleaning according to this patent specification.

FIG. 7 is a block diagram illustrating control circuitry that provides the individual control of charge roller cleaning according to this patent specification.

As shown in FIG. 7, the control circuitry includes a main controller 90 implemented as a central processing unit (CPU), random access memory (RAM), read-only memory (ROM), input/output (I/O), analog-to-digital (A/D) converter, digital-to-analog (D/A) converter, and other elements required for proper circuit operation. The main controller 90 communicates with a communication controller 91 and a scan controller 92.

During operation, the communication controller 91 receives information from an external computer via an appropriate network while communicating with a user interface (UI), and outputs image data in an appropriate form for processing by the main controller 90. According to the output from the communication controller 91, the main controller 90 transmits data for scanning to the scan controller 92, which in turn controls multiple laser diodes 93Y, 93C, 93M, and 93K, respectively, to scan the corresponding photoconductive surface according to the image data.

In addition, the main controller 90 controls operation of toner supply motors 94Y, 94M, 94C, and 94K, photoconductor drive motors 95Y, 95M, 95C, and 95K, and solenoids 96Y, 96M, 96C, and 96K, respectively, while storing data on the operation of each individual imaging unit in a non-volatile memory. Such data includes length of time each photoconductor drive motor 95 is activated, length of time each toner supply motor 94 is activated, number of pixels of each primary color contained in printed images, as well as environmental conditions under which the image forming apparatus 100 and/or each imaging unit 18 is operated. The pixel number may be readily obtained from the scan controller 92 handling digital data, and the environmental conditions are obtained using an environment sensor 97 detecting ambient temperature and humidity.

In the individual control of charge roller cleaning, the main controller 90 calculates the distance traveled by each photoconductive surface during image formation from the activation time of each photoconductor drive motor 95 to increment a distance counter by the calculated amount, which indicates an accumulated usage of the photoconductor since a previous charge roller cleaning operation. When the photoconductor cumulative usage reaches a given reference level, the main controller 90 actuates the corresponding solenoid 96 to trigger a charge roller cleaning operation in the corresponding imaging unit 18. Upon completion of charge roller cleaning, the main controller 90 resets the distance counter to initiate a new counting cycle.

Further, the main controller 90 adjusts the distance count for each individual imaging unit according to the information stored in the non-volatile memory, i.e., the environmental conditions, the number of pixels output, and the activation time of the toner supply motor. Details of the adjustment process are described later with reference to specific embodiments.

Setting the cleaning interval by the distance counter indicating the photoconductor cumulative usage in each individual imaging unit 18 enables charge roller cleaning to be properly performed according to the degree of contamination of the charge roller 70. Further, adjusting the distance counter according to the operating conditions of each individual imaging unit 18 makes the cleaning interval more appropriate for the contamination degree, achieving effective charge roller cleaning under varying operating conditions.

The individual control of charge roller cleaning described above provides charge roller cleaning at different intervals for different imaging units in the image forming apparatus 100. As mentioned, the solenoid-triggered cleaner retraction mechanism CR according to this patent specification is designed to function while the imaging unit 18 is not in service, so that charge roller cleaning takes place during intervals between print jobs. With the cleaning interval individually controlled for each imaging unit, there could be a situation where one imaging unit starts charge roller cleaning immediately after another imaging unit completes charge roller cleaning, resulting in a significant time loss for a user waiting for a print job.

The difference in the cleaning interval may be present not only between the black imaging unit and the non-black imaging unit but also among the non-black imaging units which are normally operated concurrently in formation of color images. This is because the photoconductors in different imaging units are initiated to rotate at different times for the purpose of preventing excessive consumption of energy from concurrent energization of the multiple photoconductor drive motors. In addition, adjusting the photoconductor usage according to the ratio of image areas, which in most cases varies among the different imaging units, inevitably results in further variation in the cleaning interval.

To avoid such inefficiency, the individual control of charge roller cleaning according to this patent specification may be arranged to prevent cleaning operations from successively occurring in different imaging units.

Specifically, when the photoconductor usage reaches a given first level in one imaging unit, it is determined whether the photoconductor usage reaches a given second level lower than the given first level in any other imaging unit, and charge roller cleaning is performed concurrently in all the imaging units with the photoconductor usage reaching the given second level. Such an arrangement can reduce frequency of charge roller cleaning and prevent an extended user waiting time caused by successive cleaning operations.

Although the individual control of charge roller cleaning described above is based on the cleaning interval, it should be appreciated that the charge roller cleaning may be controlled by regulating a duration of cleaning operation according to the photoconductor usage in each imaging unit. Such duration-based cleaning control may also ensure effective charge roller cleaning and reliable charging performance.

For a better understanding of the individual control of charge roller cleaning according to this patent specification, reference is now made to the following specific embodiments of the image forming apparatus 100.

EMBODIMENT 1

According to this embodiment, the image forming apparatus 100 calculates the distance traveled by each photoconductor 40 upon completion of a print job, and increments each distance counter by the calculated distance to obtain a total cumulative distance traveled since a previous charge roller cleaning operation in each imaging unit 18. When the total cumulative distance count reaches a given reference value of 5 kilometers (corresponding to printing on 5,000 sheets of A4 copy paper), the image forming apparatus 100 triggers the charge roller cleaner 77 to clean the corresponding charge roller 70. The travel distance of the photoconductor 40 may be obtained based on the rotational speed of the photoconductor and the length of time the photoconductor is rotated.

In such a configuration, the photoconductor usage obtained as a total travel distance may be adjusted by adding factors representing operating conditions of each imaging unit as detailed hereinbelow.

1. Environmental Conditions

As mentioned, the charge roller material and contaminants on the roller surface exhibit increased resistivities at lower temperatures and lower humidities, resulting in insufficient or improper charging of the photoconductive surface and concomitant degradation of image quality.

According to this embodiment, the travel distance of the photoconductor is adjusted using an environment factor a that reflects the environment temperature or humidity detected inside the image forming apparatus 100. An adjusted travel distance D is calculated by weighting an actual travel distance Di as follows:

$$D=Di*(1+\alpha) \quad (1)$$

The travel distance D thus obtained is added to the distance counter to determine the total travel distance of the photoconductor 40. The environment factor $\alpha$ is selected so that the charge roller cleaning takes place at a shorter interval when the temperature and/or humidity decreases to make the charge roller more susceptible to contamination. Table 1 shows an example of such environment factor $\alpha$, although it should be appreciated that the environment factor a may be other than those presented below, and the environmental conditions may be categorized in any suitable manner.

TABLE 1

| | Absolute humidity [g/m$^3$] | | | | |
|---|---|---|---|---|---|
| | below 5 | from 5 to 8.4 | from 8.4 to 15 | from 15 to 25 | above 25 |
| Environment factor $\alpha$ | 0.5 | 0.25 | 0 | −0.25 | −0.5 |

2. Image Area Ratio

As mentioned, printed images containing large image areas increase the amount of residual toner on the photoconductive surface and cause an increased amount of contaminants transferring to the charge roller surface.

According to this embodiment, the travel distance of the photoconductor is adjusted using a toner consumption factor $\beta$ that reflects the image area ratio, i.e., a ratio of an image area to a travel area of the photoconductive surface. The "image area" herein refers to an area of one pixel multiplied by a number of output pixels counted, and the "travel area" may be obtained by multiplying a distance traveled by the photoconductive surface with a maximum width of the working surface of the photoconductor. An adjusted travel distance D is calculated by weighting an actual travel distance Di as follows:

$$D=Di*(1+\beta) \quad (2)$$

The travel distance D thus obtained is added to the distance counter to determine the total travel distance of the photoconductor 40. The toner consumption factor β is selected so that the charge roller cleaning takes place at a shorter interval when printing is performed using higher amounts of toner that make the charge roller more susceptible to contamination. Table 2 below shows an example of such toner consumption factor β, although it should be appreciated that the toner consumption factor β may be determined in terms of the amount of toner supplied to the developing device instead of the image area ratio.

TABLE 2

| | Image area ratio [%] | | | |
|---|---|---|---|---|
| | below 3 | from 3 to 10 | from 10 to 25 | above 25 |
| Toner consumption factor β | −0.25 | 0 | 0.25 | 0.5 |

3. Aging of Process Cartridge

As mentioned, the photoconductor cleaner or the cleaning blade deteriorates with use and aging of the imaging unit to cause an increased amount of residual toner to bypass the cleaning process, resulting in an increased amount of contaminants transferring to the charge roller surface.

According to this embodiment, the imaging unit is configured in a process cartridge with the photoconductor, the photoconductor cleaner, and the charge roller integrally mounted and replaceable at the same time, and the travel distance of the photoconductor is adjusted using an aging factor γ that reflects the age of the process cartridge. An adjusted travel distance D is calculated by weighting an actual travel distance Di as follows:

$$D=Di*(1+\gamma) \quad (3)$$

The travel distance D thus obtained is added to the distance counter to determine the total travel distance of the photoconductor 40. The aging factor γ is selected so that the charge roller cleaning takes place at a shorter interval when the process cartridge approaches the end of its useful life to make the charge roller more susceptible to contamination. Table 3 below shows an example of such toner consumption factor γ, although it should be appreciated that the aging factor γ may be assigned values other than those shown in Table 3.

TABLE 3

| | Cartridge age [%] | | | |
|---|---|---|---|---|
| | below 25 | from 25 to 50 | from 50 to 75 | above 75 |
| Aging factor γ | −0.2 | 0 | 0.2 | 0.4 |

4. Combination of Condition Factors

The environment factor α, the toner consumption factor β, and the aging factor γ described above may be employed alone or in combination. For example, an adjusted travel distance D is calculated by weighting an actual travel distance Di as follows:

$$D=Di*(1+\alpha+\beta+\gamma) \quad (4)$$

The travel distance D thus obtained is added to the distance counter to determine the total cumulative travel distance of the photoconductor 40.

EMBODIMENT 2

According to this embodiment, the image forming apparatus 100 triggers the charge roller cleaner 77 in an imaging unit where the total cumulative distance count reaches a given reference point of 5 kilometers (corresponding to printing on 5,000 sheets of A4 copy paper). At the same time, the image forming apparatus 100 determines whether the total cumulative distance count reaches a certain percentage of 5 kilometers in another imaging unit. Charge roller cleaning is performed concurrently in all imaging units with the distance count reaching or approaching the 5-kilometer reference point.

Figure 8:
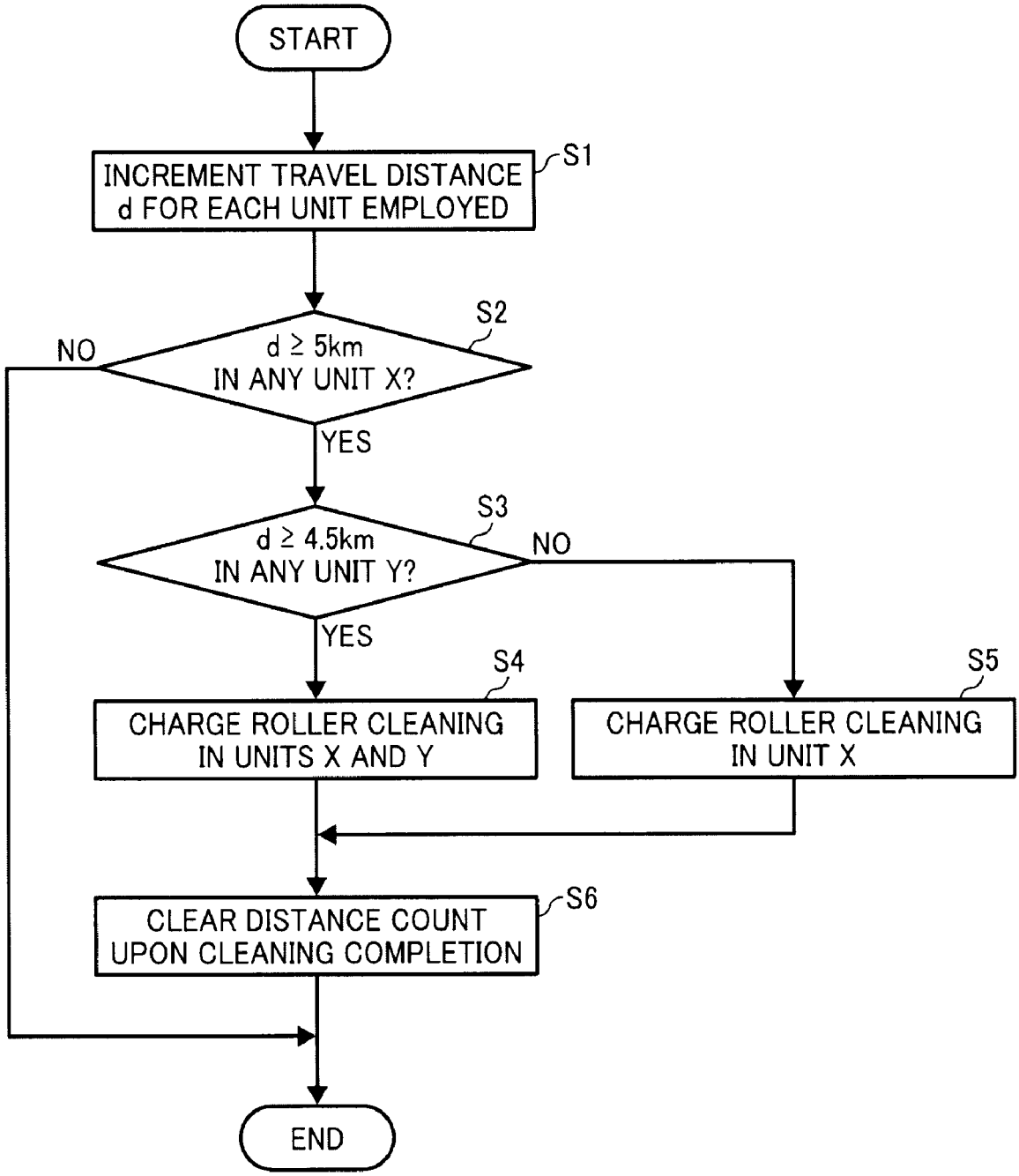
FIG. 8 is a flowchart illustrating the individual control of charge roller cleaning according to this patent specification.

FIG. 8 is a flowchart illustrating the individual control of charge roller cleaning according to Embodiment 2 of this patent specification.

Upon completion of a print job, the main controller 90 calculates the distance traveled by the photoconductor and adds the calculated value to the distance counter to obtain a total cumulative travel distance d for each imaging unit employed in the printing process (step S1).

When the total cumulative travel distance d reaches the 5-kilometer reference point in one imaging unit X ("YES" in step S2), the main controller 90 determines whether the distance counter for any other imaging unit attains 4.5 kilometers or 90% of the 5-kilometer reference point (step S3).

If the total cumulative travel distance d reaches 4.5 kilometers in one or more imaging unit Y ("YES" in step S3), the main controller 90 activates solenoids so that charge roller cleaning takes place concurrently in the imaging units X and Y (step S4).

If there is no imaging unit with the total cumulative travel distance d above 4.5 kilometers and below 5.0 kilometers ("NO" in step S3), charge roller cleaning takes place only in the imaging unit X (step S5).

When charge roller cleaning is completed, the main controller 90 clears the distance counter of the imaging units X and Y to initiate a new counting cycle (step S6).

The following describes toner and carrier materials for use in the image forming apparatus 100 of this patent specification.

The toner is mainly made of a binder resin, a coloring agent and a charge control agent. Other additives are added, if desired.

Specific examples of such resins include polystyrene, an ester copolymer of styrene acrylate, a polyester resin, etc.

As the coloring agent (for example, yellow, cyan, magenta and black) for use in the toner, known coloring agents for toner can be used. It is preferred to add such a coloring agent in an amount of from 0.1 to 15 parts by weight based on 100 parts of the binder resin.

Specific examples of the charge control agents include nigrosine dye, chromium containing complex, quaternary ammonium salt, etc. These are selected depending on the polarity of toner particles. It is preferred to add such a charge control agent in an amount of from 0.1 to 10 parts by weight based on 100 parts of the binder resin.

It is desired to add a fluidizer to toner particles. Specific examples thereof include particulates of metal oxides such as silica, titania, alumina, the particulates which are subject to treatment by a silane coupling agent, titanate coupling agent, etc., and polymer particulates such as polystyrene, polymethyl methacrylate, polyvinilydene fluoride. The particle diameter of such a fluidizer is suitably from 0.01 to 3 μm. The addition amount of the fluidizer is preferably in an amount of from 0.1 to 7.0 parts by weight based on 100 parts of the binder resin.

As a method of manufacturing a two component developing agent, any known method and a combination thereof can be used. For example, in a mixing, kneading and pulverizing method, a binder resin, a coloring agent such as carbon black, other desired additives are mixed in a dry manner followed by heating, melting and kneading the resultant by an extruder, two rollers, or three rollers. Subsequent to cooling down and hardening, the mixture is pulverized by a pulverizer such as a jet mill and classified by an air classifier to obtain a toner. It is also possible to directly manufacture a toner from a monomer, a coloring agent and an additive by a suspension polymerization method or a non-aqueous dispersion polymerization method. As a carrier contained in a two component developing agent, just a core material or a substance in which a cover layer is coated on a core material is typically used.

Ferrite or magnetite is used as the core material of a resin coated carrier in this embodiment. The core material has suitably a particle diameter of from about 20 to about 60 μm.

Specific examples of the material for use in forming a coating layer of a carrier include vinylidene fluoride, tetrafluoroethylene, hexafluoropropylene, perfluoroalkyl vinyl ether, vinyl ether formed by substitution of a fluorine atom, vinyl ketone formed by substitution of a fluorine atom, etc. As to the method of manufacturing a coating layer, it is suitable to use a spraying method, dipping method to apply the binder resin to the surface of carrier core material particle.

The following describes materials of the photoconductor or photoreceptor for use in the image forming apparatus 100 of this patent specification. A laminate type organic photoreceptor in which a photoreceptive layer including a charge generation layer and a charge transport layer is formed on an electroconductive substrate is used as the image bearing member for use in this embodiment.

Materials having a volume resistance of not greater than $10^{10}$ Ω*cm can be used for the electroconductive substrate. For example, there can be used plastic or paper having a film form or hollow cylindrical form covered with a metal such as aluminum, nickel, chrome, nichrome, copper, gold, silver, and platinum, or a metal oxide such as tin oxide and indium oxide by depositing or sputtering. Further, a tube material of aluminum, an aluminum alloy, nickel, and a stainless metal which is treated by a crafting technique such as extruding and extracting and surface-treatment such as cutting, super finishing and grinding is also usable.

The charge generating layer is a layer including a charge generating material as the main component. Inorganic and organic materials are used as the charge generating material. Specific examples thereof include monoazo pigments, disazo pigments, trisazo pigments, perylene based pigments, perynone based pigments, quinacridone based pigments, quinone based condensed polycyclic compounds, squaric acid based dyes, phthalocyanine based dyes, naphthalocyanine based pigments, azulenium salt based pigments, selenium, selenium-tellurium alloy, selenium-arsenic alloy, and amorphous silicone. These kinds of charge generating material can be used alone or in combination. The charge generating layer is formed by application of a liquid application prepared by dispersing a charge generating material and an optional binder resin in a solvent such as tetrahydrofuran, cyclohexanone, dioxane or 2-butanone, dichloroethane by a dispersion device such as a ball mill, an attritor or a sand mill. The charge generating layer is applied by using a dip coating method, a spray coating method, a bead coating method, etc. Specific examples of suitable binder resins include polyamide, polyurethane, polyester, epoxy, polyketone, polycarbonate, silicone, acryl, polyvinyl butyral, polyvinyl formal, polyvinyl ketone, polystyrene, polyacryl and polyamide. The amount of such a binder resin is from 0 to 2 parts by weight based on 1 part of the charge generating material. The charge generating layer can be formed by a known vacuum thin layer manufacturing method. The layer thickness of the charge generating layer is from 0.01 to 5 μm and preferably from 0.1 to 2 μm.

The charge transport layer is formed by dissolving or dispersing a charge transport material and a binder resin in a suitable solvent, and applying the liquid dispersion or solution to the layer below the charge transport layer followed by drying. A plasticizer or a leveling agent can be added, if desired. Among the charge transport material, there are electron transport material and positive hole transport material as a low molecule charge transport material. Specific examples of such electron transport material include electron accepting materials such as chloranil, bromanil, tetracyano ethylene, tetracyanoquino dimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-on, and 1,3,7-trinitrodibenzo thhiophene-5,5-dioxide. These charge transport material can be used alone or in combination.

Specific examples of such positive hole transport materials include electron donating materials such as oxazole derivatives, oxadiazole derivatives, imidazole derivatives, triphenyl amine derivatives, 9-(p-diethylaminostyryl anthracene), 1,1-bis-(4-dibenzyl aminophenyl)propane, styryl pyrazoline, phenyl hydrazones, a-phenyl stilbene derivatives, thiazole derivatives, triazole derivatives, phenazine derivatives, acridine derivatives, benzofuran derivatives, benzimidazole derivatives and thiophene derivatives. These positive hole transport materials can be used alone or in combination.

Specific examples of the binder resins for use in the charge transport layer together with the charge transport material include thermal curing resins and thermal plastic resins such as polystyrenes, styrene-acrylonitrile copolymers, styrene-butadiene copolymers, styrene-maleic acid anhydride copolymers, polyesters, polyvinyl chlorides, vinyl chloride-vinyl acetate copolymers, polyvinyl acetates, polyvinyl vinylidenes, polyarates, phenoxy resins, polycarbonates, cellulose acetate resins, ethyl cellulose resins, polyvinyl butyrals, polyvinyl formals, polyvinyl toluene, acrylic resins, silicone resins, epoxy resins, melamine resins, urethane resins, phenol resins, and alkyd resins.

Specific examples of the solvents include tetrahydrofuran, dioxane, toluene, 2-butanone, monochlorobenzene, dichloroethane, and methylene chloride. The thickness of the charge transport layer is suitably selected from 10 to 40 μm according to desired characteristics of the image bearing member. Specific examples of plasticizers, which are optionally added to the charge transport layer, include known plasticizers such as dibutyl phthalate and dioctyl phthalate. The content of the plasticizer in the charge transport layer is from 0 to about 30% by weight based on the binder resin contained in the charge transport layer. Specific examples of leveling agents, which are optionally added to the charge transport layer, include silicone oils such as dimethyl silicone oils and methyl phenyl silicone oils, and polymers and oligomers, which include a perfluoroalkyl group in their side chain. The content of the leveling agent in the charge transport layer is from 0 to about 1% by weight based on the binder resin included in the charge transport layer. In this embodiment, the content of the charge transport material contained in the photosensitive layer is preferably not less than 30% by weight based on the weight of the charge transport layer. When the content is too small, the light attenuation time tends to be not sufficiently secured in the high speed electrophotographic process for pulse light irradiation when a laser beam is written to an image bearing member, which is not preferred.

It is possible to form an undercoating layer between the electroconductive substrate and the photosensitive layer for the image bearing member in this embodiment. In general, an undercoating layer is mainly composed of a binder resin. Considering that a photosensitive layer is coated on the binder resin using a solvent, it is preferred to use a binder resin hardly soluble in a typical organic solvent. Specific examples of such binder resins include water soluble resins such as polyvinyl alcohol, caseine and sodium polyacrylate, alcohol soluble resins such as copolymerized nylon and methoxymethylated nylon and curing type resins which forms three dimensional network structure such as polyurethane, melamine, alkyd-melamine and epoxy resins. Fine powder pigments of metal oxides exemplified by titanium oxide, silica, alumina, zirconium oxide, tin oxide and indium oxide can be added to the undercoating layer to prevent the occurrence of moiré, reduce the residual voltage, etc. The undercoating layer can be formed by using the same solvents and the same coating methods as those for the photosensitive layer. It is also possible to use a metal oxide layer formed by using a silane coupling agents, a titanium coupling agent and a chromium coupling agent by a method such as a sol-gel method as the undercoating layer. In addition, $Al_2O_3$ formed by anodic oxidization, organic compounds such as polyparaxylylene (parylene) and inorganic materials such as SiO, $SnO_2$, $TiO_2$, ITO and $CeO_2$, which are formed by a vacuum thin layer manufacturing method can be also used for the undercoating layer. The thickness of the undercoating layer is suitably from 0 to 5 μm.

In addition, it is possible to form a protective layer on the photosensitive layer to protect the photosensitive layer and improve the durability thereof. Such a protective layer has a structure in which metal oxide particulates such as alumina, silica, titanium oxide, tin oxide, zirconium oxide and indium oxide are added to a binder resin to improve the abrasion resistance of the protective layer. Specific examples of the binder resins include styrene-acrylonitrile copolymers, styrene-butadiene copolymers, acrylonitrile-butadiene-styrene copolymers, olefin-vinyl monomer copolymers, chlorinated polyethers, aryl resins, phenol resins, polyacetal resins, polyamide resins, polyamideimide resins, polyacrylate resins, polyarylsulfon resins, polybutylene resins, polybutylene terephthalate resins, polycarbonate resins, polyether sulfone resins, polyethylene resins, polyethylene terephthalate resins, polyimide resins, acryl resins, polymethyl pentene resins, polypropylene resins, polyphenylene oxide resins, polysulphone resins, polyurethane resins, polyvinyl chloride resins, polyvinylidene resins and epoxy resins. The content of the metal oxide particulate to be added to the protective layer is usually from 5 to 30% by weight. When the content is too small, the abrasion amount tends to be large, meaning that the abrasion resistance is not improved. When the content is too large, the voltage at the light portion during irradiation significantly easily increases, which causes deterioration of sensitivity to an unignorable degree. When the protective layer is formed, a typical method such as a spraying method is adopted. The layer thickness of the protective layer is from 1 to 10 μm and preferably from about 3 to about 8 μm. When the thickness of the protective layer is too thin, the durability thereof is inferior. When the thickness of the protective layer is too thick, the productivity deteriorates in light of manufacturing and also the residual voltage significantly increases over time. The diameter of the metal oxide particulates to be added to the protective layer is suitably from 0.1 to 0.8 μm. When the particle diameter of metal oxide particulates is too large, the degree of roughness of the surface of the protective layer tends to be great so that the cleaning property deteriorates and thus the image quality deteriorates because the irradiation light easily scatters at the protective layer, resulting in deterioration of the definition. When the particle diameter of metal oxide particulates is too small, the abrasion resistance tends to be inferior. A dispersion helper is optionally added to the protective layer to improve the dispersion property of the metal oxide particulates to the main binder resin. A dispersion helper for a coating compound can be suitably used and the content thereof is from 0.5 to 4% and preferably from 1 to 2% based on the content of the metal oxide particulate.

In addition, transfer of the charges in the protective layer is accelerated by adding a charge transport material to the protective layer. The same material for use in the charge transport layer can be used as the charge transport material for use in the protective layer. It is desired to add an anti-oxidization agent, a plasticizer, an ultraviolet absorbent, a leveling agent, etc. to each layer to improve the environment resistance of the image bearing member for use in this embodiment, especially to prevent the deterioration in the sensitivity and the rise in the residual voltage thereof. The structure for the protective layer for use in the embodiment is not limited to the type in which metal oxide particles are dispersed, but it is also possible to use an optical or heat curing type resin material to form a protective layer.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus, comprising:

multiple imaging units configured to perform electrophotographic image formation, each imaging unit including:

a photoconductor;

a charging device configured to charge the photoconductor for forming an electrostatic latent image thereon;

a developing device configured to develop the electrostatic latent image;

a retractable cleaner configured to clean the charging device when in contact with the charging device; and a cleaner retraction mechanism configured to bring the retractable cleaner into contact with the charging device, the charging device and the photoconductor being installed and replaced in conjunction with each other; and a controller configured to calculate a photoconductor usage of each of the multiple imaging units, and individually control the cleaner retraction mechanism in each of the multiple imaging units according to the calculated photoconductor usage.

2. The image forming apparatus according to claim 1, wherein the controller concurrently activates the cleaner retraction mechanism in a first imaging unit and the cleaner retraction mechanism in a second imaging unit while the image formation is not being performed, the first imaging unit with the photoconductor usage reaching a given first level, the second imaging unit with the photoconductor usage reaching a given second level lower than the given first level.

3. The image forming apparatus according to claim 1, further comprising an environment sensor configured to detect environmental conditions under which at least one of the image forming apparatus and the multiple imaging units are operated, wherein the controller adjusts an interval between successive activations of the cleaner retraction mechanism according to the detected environmental conditions.

4. The image forming apparatus according to claim 1, wherein the controller calculates an image area ratio in the electrostatic latent image and adjusts an interval between successive activations of the cleaner retraction mechanism according to the calculated image area ratio.

5. The image forming apparatus according to claim 1, wherein the controller detects an amount of toner supplied to the developing device and adjusts an interval between successive activations of the cleaner retraction mechanism according to the detected amount.

6. The image forming apparatus according to claim 1, wherein the charging device includes a rotatable roller with an outer surface in close proximity to the photoconductor.

7. The image forming apparatus according to claim 6, wherein the charge roller is driven with a bias voltage obtained by superimposing an alternating current voltage on a direct current voltage.

8. The image forming apparatus according to claim 6, wherein the charge roller includes:

a metal core;

an outer layer formed of resin and configured to impart charge to the photoconductor; and a spacer formed of resin and configured to maintain a gap between the outer layer and the photoconductor.

9. The image forming apparatus according to claim 1, wherein the cleaner is a roller formed by coating a metal core with a melamine foam.

10. A process cartridge used to perform electrophotographic image formation, comprising:

a photoconductor;

a charging device configured to charge the photoconductor for forming an electrostatic latent image thereon; and a retractable cleaner configured to clean the charging device when in contact with the charging device, the charging device, the photoconductor, and the retractable cleaner being integrally mounted in the process cartridge, the process cartridge being detachably attached to an image forming apparatus, the image forming apparatus including:

a developing device configured to develop the electrostatic latent image;

a cleaner retraction mechanism configured to bring the retractable cleaner into contact with the charging device; and a controller configured to calculate a photoconductor usage of the process cartridge, and individually control the cleaner retraction mechanism according to the calculated photoconductor usage.

11. The process cartridge according to claim 10, wherein the image forming apparatus includes multiple process cartridges, and the controller concurrently activates the cleaner retraction mechanism in a first process cartridge and a second process cartridge while the image formation is not being performed, the first process cartridge with the photoconductor usage reaching a given first level, the second process cartridge with the photoconductor usage reaching a given second level lower than the given first level.

12. The process cartridge according to claim 10, wherein the controller calculates an image area ratio in the electrostatic latent image and adjusts an interval between successive activations of the cleaner retraction mechanism according to the calculated image area ratio.

13. The process cartridge according to claim 10, wherein the charging device includes a rotatable roller with an outer surface in close proximity to the photoconductor.

14. The process cartridge according to claim 13, wherein the charge roller is driven with a bias voltage obtained by superimposing an alternating current voltage on a direct current voltage.

15. The process cartridge according to claim 13, wherein the charge roller includes:

a metal core;

an outer layer formed of resin and configured to impart charge to the photoconductor; and a spacer formed of resin and configured to maintain a gap between the outer layer and the photoconductor.

16. The process cartridge according to claim 10, wherein the cleaner is a roller formed by coating a metal core with a melamine foam.

17. The process cartridge according to claim 10, further comprising a photoconductor cleaner integrally mounted therein, wherein the controller adjusts an interval between successive activations of the cleaner retraction mechanism according to aging of the process cartridge.

* * * * *